US005387771A

United States Patent [19]

Luehring

[11] Patent Number: 5,387,771

[45] Date of Patent: Feb. 7, 1995

[54] AXIAL MAGNETIC FIELD HIGH VOLTAGE VACUUM INTERRUPTER

[75] Inventor: Elmer L. Luehring, Cleveland Heights, Ohio

[73] Assignee: Joslyn Hi-Voltage Corporation, Cleveland, Ohio

[21] Appl. No.: 44,416

[22] Filed: Apr. 8, 1993

[51] Int. Cl.[6] ..... H01H 33/66

[52] U.S. Cl. ..... 200/144 B

[58] Field of Search ..... 200/144 B, 147 R, 275, 200/276,144 R, 144 B, 147 A, 147 B, 148 B

[56] References Cited

U.S. PATENT DOCUMENTS

| | | | |
|---|---|---|---|
| 3,275,777 | 9/1966 | Pflanz et al. | 200/144 B |
| 3,469,050 | 9/1969 | Robinson et al. | 200/144 B |
| 3,818,166 | 6/1974 | Emmerich | 200/144 B |
| 3,852,555 | 12/1974 | Schuöcker et al. | 200/144 B |
| 3,946,179 | 3/1976 | Murano et al. | 200/144 B |
| 4,345,126 | 8/1982 | Cherry et al. | 200/144 B |
| 4,527,028 | 7/1985 | Luehring | 200/144 B |
| 4,532,391 | 7/1985 | Bernt | 200/144 B |
| 4,568,804 | 2/1986 | Luehring | 200/144 B |
| 4,675,483 | 6/1987 | Gebel et al. | 200/144 B |
| 4,695,687 | 9/1987 | Grosse et al. | 200/144 B |
| 4,704,506 | 11/1987 | Kurosawa et al. | 200/144 B |
| 4,717,797 | 1/1988 | Hoene | 200/144 B |
| 4,760,223 | 7/1988 | Suzuki | 200/144 B |
| 4,798,921 | 1/1989 | Watanabe | 200/144 B |
| 4,839,481 | 6/1989 | Nash et al. | 200/144 B |
| 4,855,547 | 8/1989 | Toya et al. | 200/144 B |
| 4,871,888 | 10/1989 | Bestel | 200/144 B |
| 4,885,442 | 12/1989 | Kriechbaum | 200/144 B |

FOREIGN PATENT DOCUMENTS

| | | | |
|---|---|---|---|
| 2193244 | 2/1974 | France | H01H 33/66 |
| 3327513A1 | 2/1985 | Germany | H01H 33/66 |
| 2111309A | 6/1983 | United Kingdom | H01H 33/66 |
| 2199991A | 7/1988 | United Kingdom | H01H 1/06 |

OTHER PUBLICATIONS

Patent Cooperation Treaty (PCT) International Search Report mailed Jul. 13, 1994–4 pp.

*Primary Examiner*—A. D. Pellinen
*Assistant Examiner*—Michael A. Friedhofer
*Attorney, Agent, or Firm*—Marshall, O'Toole, Gerstein, Murray & Borun

[57] ABSTRACT

An axial magnetic field high voltage vacuum interrupter for interrupting the flow of electrical current in high voltage electrical circuits has a housing with a vacuum therein and two switch contacts disposed within the housing. The switch contacts are movable with respect to each other between a first position in which they are in contact with each other and a second position in which they are separated from each other by a space sufficient to interrupt the current flow through them. One or both of the switch contacts comprise a plurality of helically coiled current-carrying bars, an electrically conductive stem portion conductively coupled to the helically coiled bars at one end, and an electrically conductive contact member conductively coupled to the helically coiled bars at another end. Each of the helically coiled bars has a first portion which extends radially outward from the stem portion and a second portion which is helically coiled about an axis substantially parallel with the stem portion.

47 Claims, 4 Drawing Sheets

AXIAL MAGNETIC FIELD HIGH VOLTAGE VACUUM INTERRUPTER

BACKGROUND OF THE INVENTION

This invention relates to a new and improved axial magnetic field high voltage vacuum interrupter for interrupting the flow of electrical current in high voltage electrical circuits.

A high voltage vacuum interrupter is a type of circuit breaker or switch that is used to interrupt the flow of large currents. As used herein, the term "high voltage" refers to a voltage greater than 1,000 volts. A high voltage vacuum interrupter is disclosed in U.S. Pat. No. 4,568,804 to Elmer Luehring. The vacuum interrupter has a pair of terminals each of which is connected to a respective switch contact, one of which is stationary and one of which is movable. The switch contacts are provided in a vacuum chamber to minimize electrical arcing when the switch contacts are moved away from each other to interrupt the flow of electrical current.

Conventional high voltage vacuum interrupters have a limit to the amount of current they can interrupt due to electrical arcing since larger currents are more likely to cause sustained arcs when the switch contacts are separated. Some high voltage vacuum interrupters have been designed to generate an axial magnetic field to increase the amount of electrical current they can interrupt. The axial magnetic field helps to prevent the formation of a narrow, constricted electrical arc between the two switch contacts, thus increasing the current-interrupting capability of the interrupter.

Axial magnetic field vacuum interrupters typically include switch contacts that are provided with a current carrying tube-shaped copper cylinder having slots cut therein so that the current flows through the cylinder in a helical path to generate the axial magnetic field. One example of such a vacuum interrupter is disclosed in U.S. Pat. No. 4,695,687 to Grosse, et al.

Switch contacts produced by cutting slots in a preformed copper cylinder are relatively expensive to produce for a number of reasons. The slotting operation is relatively complicated and requires the use of relatively expensive machining apparatus. The copper cylinder in which the slots are cut is relatively expensive, and the copper removed from the cylinder by the slotting process is wasted. The complicated nature of the slotting procedure also reduces the flexibility to manufacture switch contacts of different sizes and having different electrical characteristics.

SUMMARY OF THE INVENTION

The present invention is directed to an axial magnetic field high voltage vacuum interrupter for interrupting the flow of electrical current in high voltage electrical circuits in which a plurality of helically coiled bars are provided to generate the axial magnetic field.

The vacuum interrupter has a housing with a vacuum therein and two switch contacts disposed within the housing. The switch contacts are movable with respect to each other between a first position in which they are in contact with each other and a second position in which they are separated from each other by a distance sufficient to allow a voltage to exist without electrical breakdown.

One or both of the switch contacts comprise a plurality of helically coiled current-carrying bars, an electrically conductive stem portion conductively coupled to the helically coiled bars at one end, and an electrically conductive contact member conductively coupled to the helically coiled bars at another end. The helically coiled bars are coiled about an axis substantially parallel with the stem portion.

The helically coiled bars are formed by orienting a plurality of bars having relatively straight portions circumferentially about a substantially cylindrical space having a central axis and helically twisting the bars about the central axis. The bars may be composed of widely available copper wire or rod.

Helically coiling the bars may be accomplished with a machine having a frame and a clamp fixed with respect to the frame in which one end of a switch contact assembly having a plurality of bars is clamped. The machine has a tool for twisting the other end of the switch contact assembly so as to helically coil the bars of the assembly. The tool is rotatable and translatable with respect to the clamp. The tool has a generally cylindrical central recess to accommodate the stem portion of the switch contact assembly and a plurality of slots spaced apart about the circumference of the tool to accommodate the bars of the switch contact assembly.

One or both of the helical switch contacts of the present invention may have an electrically conductive contact member with a circumferential outer portion and a central inner portion, the inner portion being recessed with respect to the outer portion, with the helical bars being directly connected to the outer portion to provide a substantially uninterrupted cylindrical current path from the helical bars to the outer portion of the contact member.

Providing a switch contact with helically coiled individual bars is advantageous in a number of respects. Because helically coiling the bars is less wasteful than other methods of manufacture, such as cutting slots in a copper cylinder, forming the switch contact is relatively inexpensive. The required components of the switch contact are also less expensive since relatively small diameter copper wire or rod is less expensive than a relatively large diameter copper cylinder and since no copper is wasted during the slotting process. Also, because the method of manufacture is simpler, there is greater flexibility to manufacture a number of different switch contact designs having different current-interrupting capabilities.

These and other features and advantages of the present invention will be apparent to those of ordinary skill in the art in view of the detailed description of the preferred embodiment, which is made with reference to the drawing, a brief description of which is provided below.

DETAILED DESCRIPTION OF A PREFERRED EMBODIMENT

Figure 1:
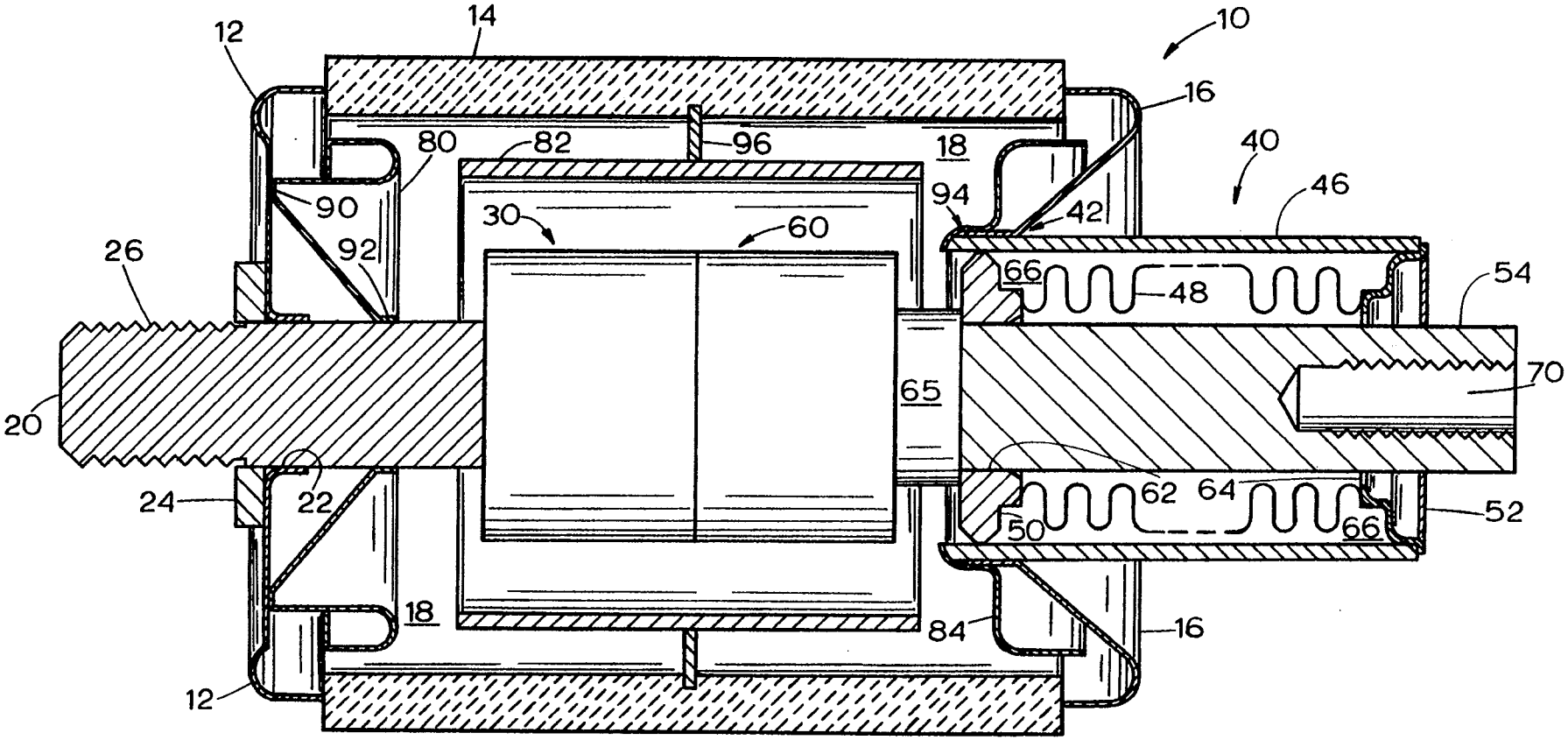
FIG. 1 is a cross-sectional view of a preferred embodiment of an axial magnetic field high voltage vacuum interrupter with the two switch contacts shown schematically.

A preferred embodiment of an axial magnetic field (AMF) high voltage vacuum interrupter 10 is shown in FIG. 1. The vacuum interrupter 10 has a vacuum housing comprising a first, generally circular metallic flange 12, a cylindrical ceramic casing 14, and a second, generally circular metallic flange 16. The interior 18 of the vacuum housing is substantially evacuated of all gases and hermetically sealed from the outside environment so as to maintain a vacuum.

A stationary metal stem 20 is provided within a central bore 22 formed in the first flange 12. A metal collar 24 is provided over the stationary stem 20 and is flush with the exterior surface of the flange 12. The portion of the stationary stem 20 which extends outside the vacuum housing is threaded to provide an electrical terminal 26. A stationary switch contact shown schematically at 30 is fixed to the opposite end of the stationary stem 20.

A bellows module 40 is provided within a central bore 42 formed in the second flange 16. The bellows module 40 comprises a cylindrical metal bellows housing 46, a metal bellows 48, a generally annular metal slide member 50, and a metal cap 52. A movable stem 54 attached to a movable switch contact shown schematically at 60 is provided in a circular central bore 62 in the slide member 50 and passes through a circular aperture 64 formed in the metal cap 52. The circular aperture 64 has a substantially larger diameter than the diameter of the stem 54 to allow unencumbered movement of the movable stem 54 in the bellows module 40. A collar 65 may be provided on the stem 54 to abut the metal slide 50.

The metal cap 52 is sealed to both the bellows housing 46 and the end of the bellows 48 shown in the right-hand portion of FIG. 1, and the slide member 50 is sealed to the end of the bellows 48 shown in the left-hand portion of FIG. 1, so as to provide a hermetically sealed, substantially evacuated chamber 66 in the space between the bellows housing 46 and the bellows 48. Because the chamber 66 is evacuated, no gas or other contaminant can pass between the exterior of the slide member 50 and the interior of the bellows housing 46 to cause deterioration of the vacuum provided in the interior 18 of the vacuum housing.

The end of the movable stem 54 opposite the movable switch contact 60 has a threaded portion 70 to allow it to be connected to a conventional switch actuator mechanism (not shown) to cause the movable stem 54 to be laterally translated so that the movable switch contact 60 may be selectively moved to make or break contact with the stationary switch contact 30. Such a switch actuator mechanism is disclosed in U.S. Pat. No. 4,568,804 to Elmer L. Luehring, the disclosure of which is incorporated herein by reference.

A vapor shield is provided in the interior 18 of the vacuum housing to provide a condensing surface for metallic vapor products resulting from electrical arcing across the open switch contacts 30, 60. The vapor shielding, which substantially surrounds the switch contacts 30, 60, comprises a first generally circular flange 80, a cylindrical member 82, and a second generally circular flange 84. The flange 80 is connected to the flange 12 at a circumferential point 90 and to the stationary stem 20 at a circumferential point 92, and the flange 84 is connected to the bellows housing 46 and flange 16 at a circumferential area 94. The cylindrical member 82 is secured in place via an annular support member 96 provided within an annular groove formed in the interior of the ceramic casing 14.

Figure 2:
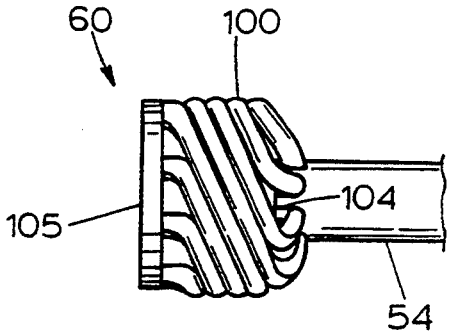
FIG. 2 is a view of an embodiment of a switch contact in accordance with the invention.

FIG. 2 illustrates one embodiment of the switch contacts 30, 60 shown schematically in FIG. 1. The switch contacts 30, 60 may be identical in structure. Referring to FIG. 2, the switch contact 60 comprises a plurality of copper bars 100 helically coiled about a support member 102 (FIG. 3) of solid dielectric material so that the adjacent bars 100 nearly touch each other. Each of the bars 100 has a first end which is provided in a respective slot 104 formed in the stem 54 and a second end which is electrically coupled to an electrically conductive contact member or button 105. Each bar 100 has a first portion which extends radially from the stem 54 at a substantially right angle to the stem 54 and a second portion which is helically coiled about an axis passing through the stem 54.

Figure 3:
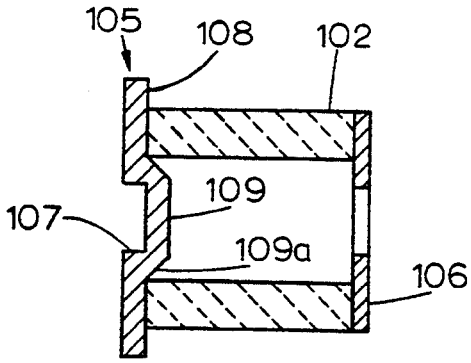
FIG. 3 is a cross section of a portion of the switch contact of FIG. 2.

FIG. 3 is a cross-sectional view of a portion of the helical switch contact 60 showing the support member 102, an optional washer 106, and one embodiment of the contact button 105. The helical bars 100 and the stem 54 are not shown.

Referring to FIG. 3, the contact button 105 has one side with a cylindrical recess 107 formed therein. The other side of the contact button 105 has a circumferential outer surface 108 and a frustoconical extension 109 formed in the center of the outer surface 108.

The thickness of the contact button 105 is non-uniform, having a relatively larger thickness at an annular angled portion **109*a* of the frustoconical extension 109 than at either the center or the circumferential portion 108. The increase in thickness at the angled portion 109*a* of the extension 109 may occur at a point about halfway between the center of the contact button 105 and its outside diameter. The increased thickness of the contact button 105 is for the purpose of limiting the flux in the central portion of the contact button 105**.

The contact button 105 may have configurations other than that shown in FIG. 3, such as a cylindrical disk with both sides being flat. The contact button 105 is preferably a composite material of 50–75% copper, with the remaining portion of the button composed essentially of chromium.

The support member 102, which is preferably of vitrified high alumina ceramic, such as 95% aluminum oxide, is cylindrical in shape with a central bore formed therein. A first face of the support member 102 abuts the circumferential outer surface 108 of the contact button 105, and the central bore in the support member 102 permits clearance of the frustoconical extension 109.

The other face of the support member 102 abuts the washer 106. The other side of the washer 106 abuts the stem 54 and portions of the coiled bars 100.

When the vacuum interrupter 10 is operated to pass current therethrough, the contact switches 30, 60 are pushed together with a force on the order of 100–150 pounds. Preferably, the support members 102 in the contact switches 30, 60 provide axial support so that the load is not borne by the helical bars 100 which might otherwise be deformed. However, depending on the rigidity of the formed bars in the switch contacts 30, 60, it may be possible to omit the support members 102 from the switch contacts 30, 60.

Figure 4:
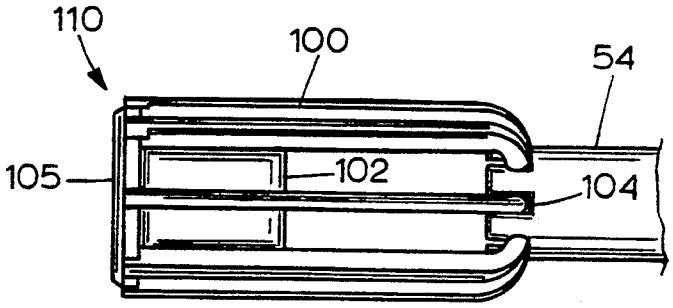
FIG. 4 is a view of a switch contact assembly.

As described in more detail below, the helical switch contact 60 is produced by applying a twisting force to the opposite ends of a switch contact assembly 110 having straight bars 100 (except for the 90° bends), which is shown in FIG. 4, to deform the bars 100 to the helical shape shown in FIG. 2. It should be noted that the switch contact assembly 110 of FIG. 4 is substantially longer than the finished switch contact 60 (FIG. 2) since helically twisting the bars 100 shortens their axial length. Accordingly, the support member 102 occupies only a portion of the interior of the contact assembly 110. The length of the support member 102 may be determined empirically or mathematically so that when the bars 100 are helically twisted a predetermined amount, such as 180°, the faces of the support member 102 will be substantially adjacent the contact button 105 and the stem 54.

Figure 5:
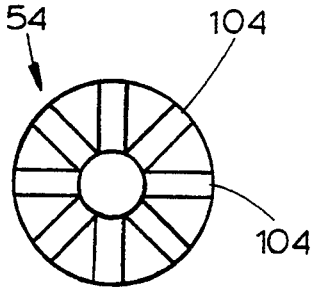
FIG. 5 is a view of one end of a switch contact stem portion having slots formed therein.

FIG. 5 illustrates the positioning of the slots 104 about the circumference of a bore in the stem 54. Similar slots may optionally be used in the contact button 105 to position the other ends of the bars 100, as shown by slots 112 in FIG. 6.

Figure 7A:
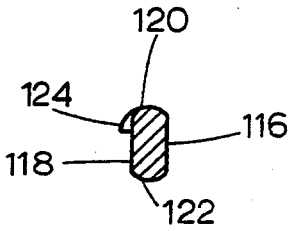
FIGS. 7A and 7B illustrate one embodiment of a bar for use in a switch contact prior to its being helically coiled.
Figure 7B:
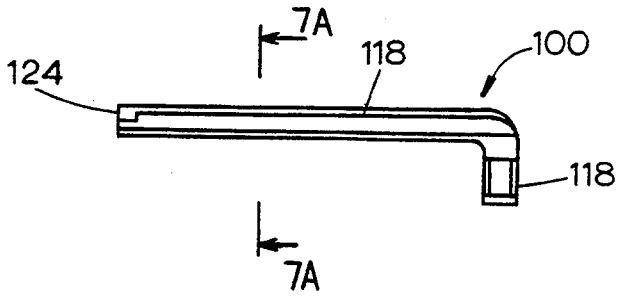

Referring to FIGS. 7A and 7B, one of the bars 100 is shown prior to its being helically coiled. The bar 100 may be formed from wire or rod, such as copper #6 AWG wire (having a diameter of 0.162 inches). The diameter of the wire or rod used depends upon the characteristics of the high voltage electrical circuit in which the switch contact 60 is to be used. The diameters of the wire or rod may be selected so that the total cross-sectional area of the bars 100 will be substantially the same as the cross-sectional area of the portion of the stem 54 through which current flows.

The wire is bent at an angle of approximately 90° at a point relatively close to one of its ends, and then the wire is partially flattened by moderate mechanical pressure to produce flattened portions 116, 118. As shown in FIG. 7A, the partial flattening of the wire results in a bar 100 having a non-rectangular cross-sectional area bounded by alternating flat portions 116, 118 and curved portions 120, 122.

At one end of the bar 100, the width of the flat portion 118 may optionally be narrowed to produce a small projecting locating lug 124 if slots 112 in the contact button 105 are utilized. The width of the slots 112 in the contact button 105 should be selected to be slightly larger than the width across the flattened portions 116, 118 of the bar 100, but smaller than the width of the bar 100 including the lug 124, so that the lugs 124 prevent the bars 100 from entering the slots 112 by more than a predetermined amount.

Figure 6:
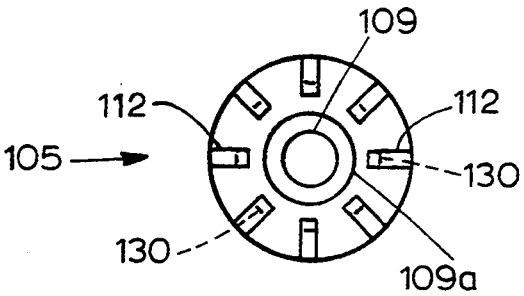
FIG. 6 is a view of one face of a contact button having slots formed therein.

Alternatively, instead of providing the lugs 124, the slots 112 in the contact button 105 could be provided with a predetermined depth, as indicated by dotted lines 130 in FIG. 6, to control the amount by which the bars 100 enter the slots 112. If the bars 100 are not brazed within the slots 112 prior to the switch contact assembly 110 being helically twisted, it may be advantageous to omit the lugs 124 and provide deeper slots 112 to minimize any likelihood of the bars 100 being pulled from the slots 112.

Figure 8:
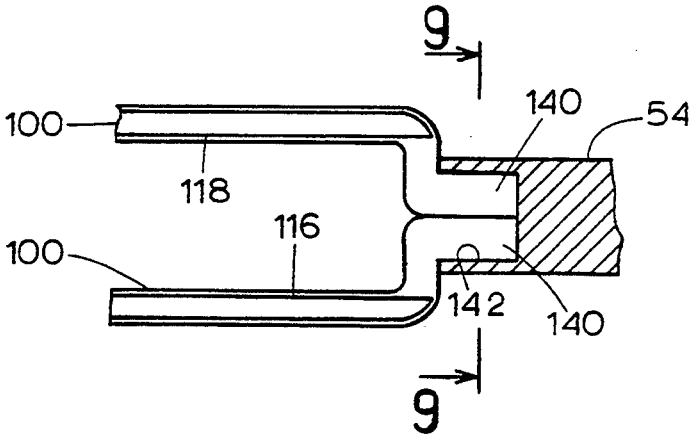
FIGS. 8 and 9 illustrate a portion of an alternative embodiment of a switch contact.
Figure 9:
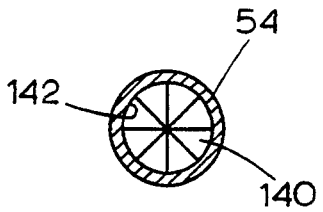

A portion of an alternative embodiment of a switch contact assembly is shown in cross-section in FIG. 8. In the alternative embodiment, the shape of the bars 100 has been modified by providing a second approximately 90° bend in close proximity to the first 90° bend so that the end of each bar 100 in the stem 54 is substantially parallel, but offset from, the main length of the bar 100. The portion of each bar 100 between the two 90° bends passes over the end of the stem 54. In FIGS. 8 and 9, the ends of the bars 100 are designated 140. As shown in FIG. 9, the ends 140 of the bars 100 are pie-shaped, so that when eight bars 100 are assembled within the stem 54, they fit snugly within a cylindrical bore 142 formed in the stem 54.

An advantage of the switch contact assembly construction of FIGS. 8 and 9 is that the pie-shaped ends 140 prevent the bars 100 from bowing outwardly so that they remain in a relatively fixed position. As a result, the helical coiling of the bars 100 can be performed without the need to braze the bars 100 to the stem 54 or provide a positioning means to keep the bars 100 in place.

Figure 10:
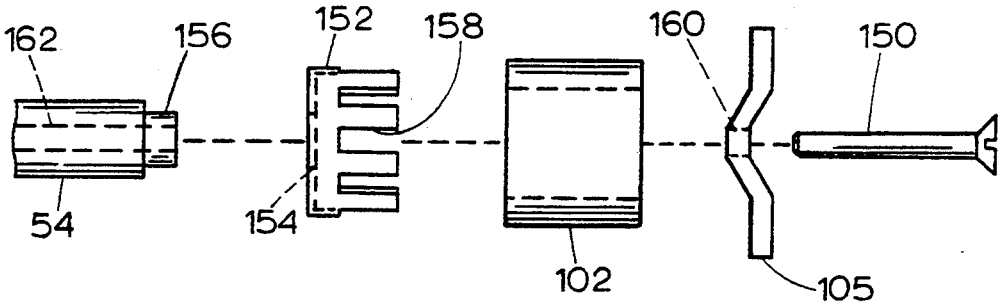
FIG. 10 is an exploded view of another alternative embodiment of a switch contact sans bars.

A portion of another embodiment of one of the switch contacts 30, 60 is shown in FIG. 10. In this embodiment, a screw 150 is used to secure the contact button 105, the bars 100 (not shown in FIG. 10), and the support member 102 to the stem 54 via a stem coupler 152. The contact button 105 shown in FIG. 10 has a central recessed portion like the contact button of FIG. 3; however, the thickness of the contact button 105 of FIG. 10 is substantially uniform. The screw 150 is preferably composed of a material less conductive than copper, such as stainless steel, to minimize the amount of current which passes through it.

The stem coupler 152 has a central bore 154 in which a cylindrical extension 156 of the stem 54 is disposed upon assembly and radial slots 158 in which the bars 100 are disposed. After the bars 100 have been helically coiled and provided in the slots 158, the contact switch of FIG. 10 is assembled by passing the screw 150 through a bore 160 in the contact button 105, the bore formed in the support member 102, the bore 154 formed in the stem coupler, and into a threaded bore 162 formed in the stem 54. The use of the screw 150 may obviate the need to braze the bars 100 to the stem coupler 158 and/or the contact button 105.

Machine For Forming Helical Switch Contact

Figure 11A:
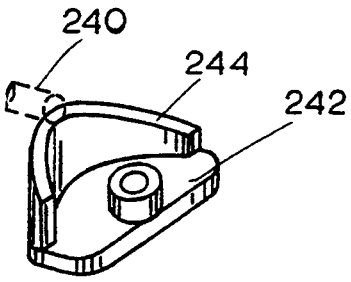
FIG. 11A is a perspective view of a cam roller and camming surface of the machine of FIG. 11.
Figure 11B:
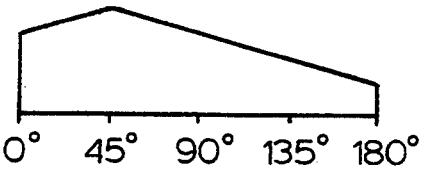
FIG. 11B is a graph of the elevation of the camming surface of FIG. 11A with respect to the rotational position of the machine.
Figure 11:
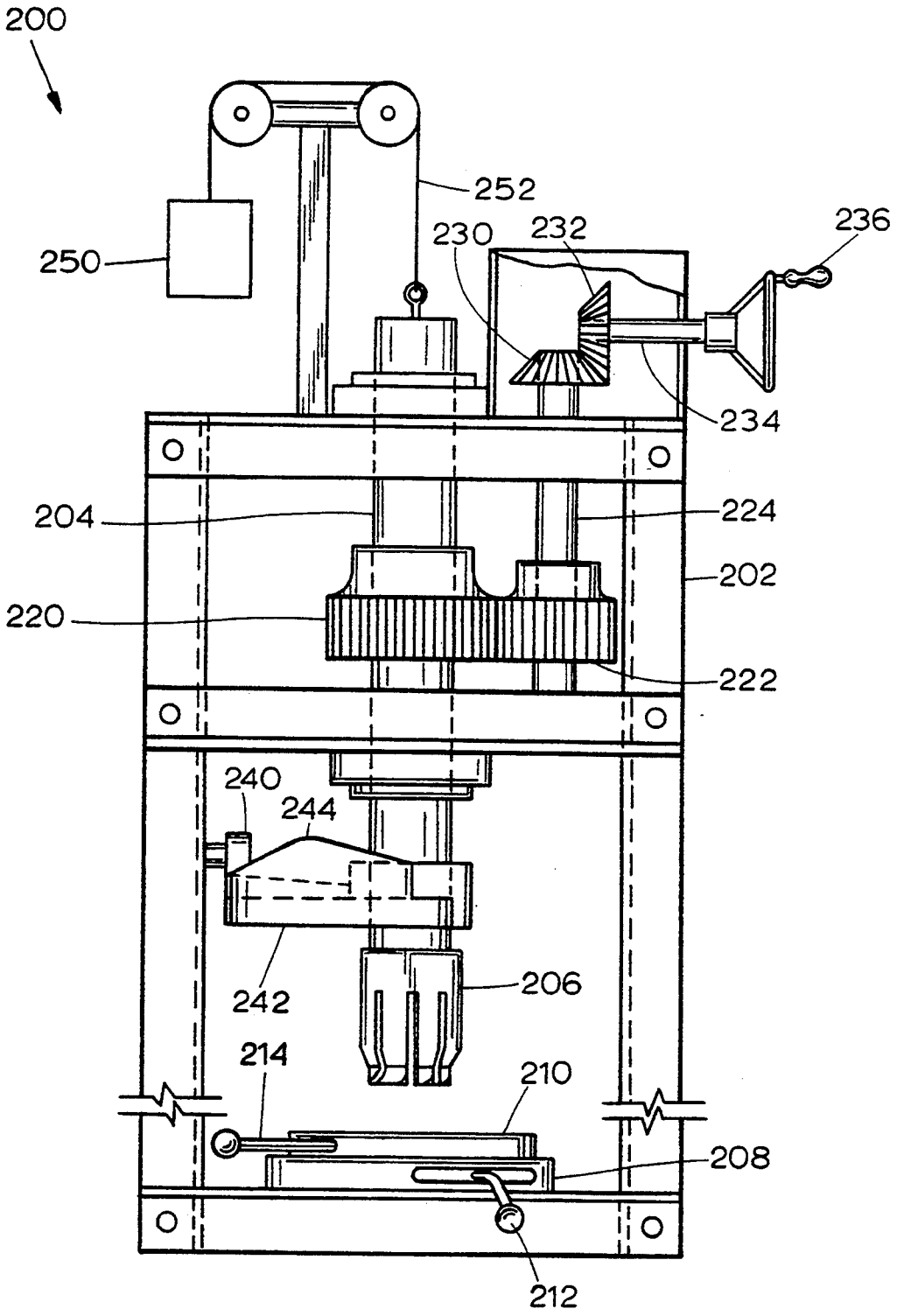
FIG. 11 is an illustration of a machine for forming a helical switch contact from a switch contact assembly.

A machine 200 for use in forming the helical switch contact from the switch contact assembly 110 (FIG. 4) is shown in FIG. 11. The machine 200 has a metal frame 202 in which a rotatable main shaft 204 is journaled. The main shaft 204 has a tool 206 removably coupled to its lower end into which the end of the switch contact assembly adjacent the stem 54 is inserted.

A conventional chuck holding mechanism 208 and a grip mechanism 210 are provided directly beneath the tool 206 for firmly holding the other end of the switch contact assembly stationary. The chuck holding mechanism 208 has a number of jaws (not shown) which, when tightened via a lever 212, tightly grip the outer periphery of the contact button 105 of the switch contact assembly. After the jaws are tightened, the grip mechanism 210 is actuated via a lever 214. The grip mechanism 210 includes a rotatable threaded member (not shown) which, when rotated via lever 214, exerts downward force on the jaws to prevent them from moving.

The main shaft 204 has a spur gear 220 disposed thereon. The spur gear 220 is driven by another spur gear 222 provided on a rotatable jack shaft 224 journaled in the metal frame 202. A bevel gear 230 is disposed on the upper end of the jack shaft 224 and is driven by another bevel gear 232 attached to a shaft 234 driven by a manually operated crank 236. Rotation of the crank 236 causes rotation of the bevel gears 230, 232, the jack shaft 224, the main shaft 204, and the tool 206. Rotation of the main shaft 204 could be controlled via a motor (not shown) instead of the crank 236.

In addition to being rotatable, the main shaft 204 is vertically translatable upwardly and downwardly. The vertical position of the main shaft 204 is controlled by a camming mechanism comprising a cam roller 240 fixed to the metal frame 202 and a camming plate 242 fixed to the main shaft 204. The outer periphery of the camming plate 242 has a camming surface 244 upon which the camming roller 240 rolls.

The elevation of the camming surface 244 varies with the rotational position of the main shaft 204. A perspective view of the camming plate 242 and the camming surface 244 is shown in FIG. 11A, and a graph of the elevation of the camming surface 244 with respect to rotational position of the main shaft 204 in degrees is shown in FIG. 11B, with 0° representing the start of the helical twisting operation and 180° representing the end of the twisting operation. The vertical positioning the main shaft 204 in accordance with the camming surface 244 is described in more detail below.

A counterbalance 250 is connected to the top of the main shaft 204 via a cable 252. The counterbalance 250 may provide a slight positive upward bias to the shaft 204 to ensure that the camming roller 240 is always in contact with the camming surface 244. The spur gears 220, 222 have sufficient vertical width so that they always make contact with each other despite the vertical translation of the main shaft 204 with respect to the vertically fixed jack shaft 224.

Figure 12A:
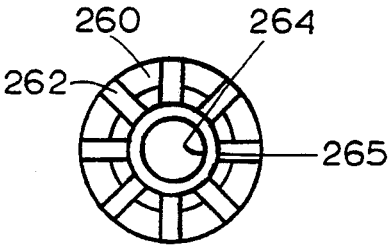
FIGS. 12A and 12B illustrate the tool of the machine of FIG. 11.
Figure 12B:
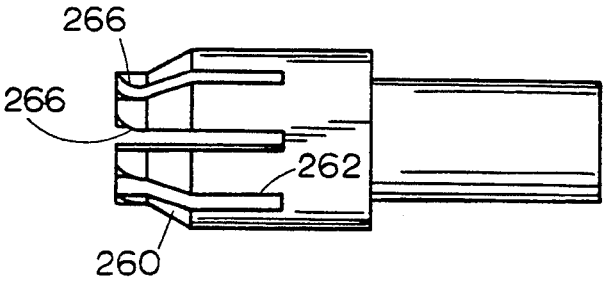

The tool 206 at the bottom end of the main shaft 204 is shown in FIGS. 12A and 12B. The tool 206 has a plurality of fingers 260 equally spaced about its periphery, one finger 260 for each bar in the contact assembly to be helically twisted. The fingers 260 are separated by slots or spaces 262, with each space 262 having a width slightly larger than that of one of the bars so that the bars fit into the spaces 262. The tool 206 has an internal bore 264 of a sufficient diameter to accommodate the stem portion 54 of the switch contact assembly and an internal bore 265 sufficient to accommodate the support member 102. The tip of each of the fingers 260 is curved, as indicated at 266.

Method of Forming Helical Switch Contact

A method of forming a helical switch contact is described below initially, a plurality of bars 100 are formed from wire or rod by cutting them to equal lengths. The bars may be bent at a 90° angle adjacent one of their ends, and they may be partially flattened as shown in FIGS. 7A and 7B. Instead of a single bend, the bars may be provided with two substantially 90° bends as shown in FIG. 8.

After the bars are formed, a switch contact assembly, such as the one shown in FIG. 4, is formed. For bars formed in accordance with FIG. 7B, the bars are preferably brazed to the stem portion 54. For bars formed in accordance with FIG. 8, it is unnecessary to braze the bars to the stem portion 54.

After the dielectric support member 102 is provided within the space enclosed by the bars, the other ends of the bars are connected to a contact button 105 having a desired configuration. As described above, the contact button 105 may be flat on both sides, it may have a central annular recess and be of uniform thickness, or it may have a central recess and be of nonuniform thickness. The side of the contact button 105 adjacent the ends of the bars may have slots or no slots.

Prior to or after their incorporation into the switch contact assembly, the bars may be coated with an insulating material, such as a mixture of water, aluminum oxide powder and glass, to prevent electrical short circuits between the bars as a result of their touching each other due to erratic twisting or lumps on the bars.

Prior to clamping the switch assembly into the machine 200, the main shaft 204 is rotated so that it is positioned at its starting point, with the cam roller 240 being positioned on the beginning of the cam surface 244, designated 0° in FIG. 11B. The end of the switch contact assembly adjacent the stem 54 is then inserted into the tool 206 so that the bars are disposed within the slots 262 between the fingers 260. The other end of the switch contact assembly is clamped into the machine 200 by clamping the contact button 105 of the assembly into the chuck holding mechanism 208 and tightening the grip mechanism 210.

After the switch contact assembly is clamped, the support member 102 is moved to the bottom portion of the switch contact assembly, adjacent the contact button 105, and the crank 236 is turned to cause the main shaft 204 and the tool 206 to rotate, thus starting to helically deform the bars. Since the outer diameter of the support member 102 is approximately the same as the inner diameter of the cylindrical space enclosed by the bars, the bars will begin to helically deform about the circumference of the support member 102. The curved portions 266 of the fingers 260 impart a relatively smooth bend to the bars.

As the bars are helically deformed, the tool 206 will first be lowered until about a 45° twist angle is reached (where there are eight bars radially spaced 45° apart), and then the tool 206 will be raised at a substantially constant rate until the helical twisting is completed, which preferably occurs at about 180°, in accordance with the elevation of the camming surface as shown in FIG. 11B.

The initial lowering of the tool 206 (from 0° to 45°) is performed to ensure that the initial turning of the top portion of the switch assembly accomplishes a tight or highly compressed twist. It should be appreciated that when a straight, vertically positioned bar is initially twisted at a twisting point where the rounded portion 266 of one of the fingers 260 of the tool 206 makes contact with it, the elevation of the twisting point will temporarily decrease as the twisting proceeds.

When the bar is twisted enough so that the twisted point touches the adjacent bar (which is 45° away where eight bars are used), the bar is at that point fully twisted, and from then on, the twisting point is moved slowly upwards along the bar by raising the elevation of the tool 206. Thus, when a camming surface such as the one shown in FIGS. 11A and 11B is used, the lower parts of the bars are twisted first, with the higher parts of the bars being subsequently twisted. Although a particular slope profile for the camming surface 244 is illustrated, another slope profile could be used.

Numerous modifications could be made to the helical switch contact and method of forming the switch contact as described above. The helical switch contact could be twisted in other ways. For example, it would not be necessary to make the entire assembly 110 of FIG. 4 prior to twisting. The assembly might consist only of the bars 100 connected to the stem 54, without the support 102 and the contact button 105. In lieu of the support 102, the bars 100 could be twisted about a cylindrical member, such as a steel rod, that is removed from the interior of the bars after the twisting is completed.

Alternatively, instead of using rods having a 90° bend therein, totally straight rods could be brazed between a pair of flat cylindrical elements, similar to the contact button 105, and the cylindrical elements could be twisted with respect to each other.

Further modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An axial magnetic field high voltage vacuum interrupter for interrupting the flow of electrical current in high voltage electrical circuits comprising:

a housing having a substantial vacuum therein; and first and second switch contacts disposed within said housing and movable with respect to each other between a first position in which said first and second switch contacts are in contact with each other and a second position in which said first and second switch contacts are separated from each other by a distance sufficient to allow a voltage to exist without electrical breakdown following interruption, at least one of said first and second switch contacts comprising:

an electrically conductive stem portion;

a plurality of electrically conductive current-carrying bars each having a first end and a second end, said first ends of said bars being conductively coupled to said electrically conductive stem portion, each of said bars having a first portion which extends radially outward from said stem portion and a second portion which is helically coiled about an axis substantially parallel with said stem portion; and an electrically conductive contact member conductively coupled to said second ends of said electrically conductive bars.

2. An axial magnetic field high voltage vacuum interrupter as defined in claim 1 additionally comprising a vapor shield provided in the interior of said housing between said housing and said first and second switch contacts.

3. An axial magnetic field high voltage vacuum interrupter as defined in claim 1 wherein said electrically conductive bars each have a non-rectangular cross section in a plane which includes said axis.

4. An axial magnetic field high voltage vacuum interrupter as defined in claim 3 wherein said non-rectangular cross section encompasses an area bounded by two curved portions alternated with two substantially flat portions.

5. An axial magnetic field high voltage vacuum interrupter as defined in claim 1 wherein said first ends of said electrically conductive bars are brazed to said electrically conductive stem portion.

6. An axial magnetic field high voltage vacuum interrupter as defined in claim 1 wherein said electrically conductive contact member has a circumferential outer portion and a central portion occupying an area within said circumferential outer portion, said central portion being axially recessed with respect to said circumferential outer portion.

7. An axial magnetic field high voltage vacuum interrupter as defined in claim 6 wherein said electrically conductive contact member has a non-uniform thickness.

8. An axial magnetic field high voltage vacuum interrupter as defined in claim 6 wherein said circumferential outer portion of said contact member has a first thickness, wherein said central portion of said contact member has a second thickness, and wherein said second thickness is greater than said first thickness.

9. An axial magnetic field high voltage vacuum interrupter as defined in claim 1 wherein a support member is disposed within the helically coiled second portions of said bars.

10. An axial magnetic field high voltage vacuum interrupter as defined in claim 1 wherein said first and second switch contacts have essentially the same configuration.

11. An axial magnetic field high voltage vacuum interrupter as defined in claim 1, wherein the second portion of each of said bars has a thickness; and wherein the second portion of each of said bars is coiled about said axis for a distance parallel to said axis, said distance being at least about twice the thickness of the second portions of said bars.

12. An axial magnetic field high voltage vacuum interrupter as defined in claim 1, wherein the second portion of each of said bars has a thickness;

wherein the second portion of each of said bars is disposed between two adjacent second portions of said bars; and wherein the second portion of each of said bars is helically coiled so that the second portion of each of said bars is spaced from each of said two adjacent second portions of said bars by a distance less than the thickness of the second portions of said bars.

13. An axial magnetic field high voltage vacuum interrupter as defined in claim 1 wherein said electrically conductive current-carrying bars constitute the only electrically conductive path between said electrically conductive stem portion and said electrically conductive contact member.

14. An axial magnetic field high voltage vacuum interrupter as defined in claim 1 wherein said electrically conductive bars are composed of a first conductive material and wherein said electrically conductive contact member is composed of a second conductive material different than said first conductive material.

15. A switch contact for an axial magnetic field high voltage vacuum interrupter for interrupting the flow of electrical current in high voltage electrical circuits, said switch contact comprising:

an electrically conductive stem portion;

a plurality of individual electrically conductive current-carrying bars each having a first end and a second end, said first ends of said bars being conductively coupled to said electrically conductive stem portion, each of said bars being helically coiled about an axis substantially parallel with said stem portion; and an electrically conductive contact member conductively coupled to said second ends of said electrically conductive bars.

16. A switch contact as defined in claim 15 wherein said electrically conductive bars each have a non-rectangular cross section in a plane which includes said axis.

17. An axial magnetic field high voltage vacuum interrupter as defined in claim 16 wherein said non-rectangular cross section encompasses an area having a curved border section.

18. An axial magnetic field high voltage vacuum interrupter as defined in claim 16 wherein said non-rectangular cross section encompasses an area bounded by two curved portions alternated with two substantially flat portions.

19. An axial magnetic field high voltage vacuum interrupter as defined in claim 15 wherein a support member is disposed within the helically coiled second portions of said bars.

20. A switch contact as defined in claim 15 wherein the total cross sectional area of said electrically conductive bars is substantially equal to the cross sectional area of said electrically conductive stem.

21. A switch contact as defined in claim 15 wherein said first ends of said electrically conductive bars are brazed to said electrically conductive stem portion.

22. A switch contact as defined in claim 15 wherein said second ends of said electrically conductive bars are brazed to said electrically conductive contact member.

23. A switch contact as defined in claim 15 additionally comprising a screw, wherein said electrically conductive contact member has a central bore formed therein and said stem portion has a central threaded bore formed therein, said screw being provided through said central bore in said contact member and screwed into said threaded bore in said stem portion.

24. A switch contact as defined in claim 15 wherein said electrically conductive contact member has a face which is non-planar.

25. A switch contact as defined in claim 24 wherein said electrically conductive contact member has a non-uniform thickness.

26. A switch contact as defined in claim 25 wherein said circumferential outer portion of said contact member has a first thickness, wherein said central portion of said contact member has a second thickness, and wherein said second thickness is greater than said first thickness.

27. A switch contact as defined in claim 24 wherein said electrically conductive contact member has a circumferential outer portion and a central portion occupying an area within said circumferential outer portion, said central portion being recessed with respect to said circumferential outer portion.

28. A switch contact as defined in claim 15 including at least four electrically conductive current-carrying bars.

29. A switch contact as defined in claim 15 including at least eight electrically conductive current-carrying bars.

30. A switch contact as defined in claim 15 wherein each of said bars has portion which extends radially outward from said stem portion.

31. A switch contact as defined in claim 15, wherein the second portion of each of said bars has a thickness; and wherein the second portion of each of said bars is coiled about said axis for a distance parallel to said axis, said distance being at least about twice the thickness of the second portions of said bars.

32. A switch contact as defined in claim 15, wherein the second portion of each of said bars has a thickness;

wherein the second portion of each of said bars is disposed between two adjacent second portions of said bars; and wherein the second portion of each of said bars is helically coiled so that the second portion of each of said bars is spaced from each of said two adjacent second portions of said bars by a distance less than the thickness of the second portions of said bars.

33. A switch contact as defined in claim 15 wherein said electrically conductive bars are composed of a first conductive material and wherein said electrically conductive contact member is composed of a second conductive material different than said first conductive material.

34. A switch contact for an axial magnetic field high voltage vacuum interrupter for interrupting the flow of electrical current in high voltage electrical circuits, said switch contact comprising:

an electrically conductive stem portion;

a plurality of electrically conductive current carrying helical members each having a first end and a second end, said first ends of said members being connected to said electrically conductive stem portion, said electrically conductive helical members being provided in a helical path;

an electrically conductive contact member electrically coupled to said second ends of said electrically conductive helical members, said contact member having a circumferential outer portion and a central portion occupying an area within said circumferential outer portion, said central portion being recessed with respect to said circumferential outer portion, said electrically conductive helical members being directly connected to said circumferential outer portion of said electrically conductive contact member to provide a substantially uninterrupted cylindrical current path from said helical members to said circumferential outer portion.

35. A switch contact as defined in claim 34 wherein said electrically conductive contact member has a non-uniform thickness.

36. A switch contact as defined in claim 34 wherein said circumferential outer portion of said contact member has a first thickness, wherein said central portion of said contact member has a second thickness, and wherein said second thickness is greater than said first thickness.

37. A switch contact as defined in claim 34,
wherein the second portion of each of said bars has a thickness; and
wherein the second portion of each of said bars is coiled about said axis for a distance parallel to said axis, said distance being at least about twice the thickness of the second portions of said bars.

38. A switch contact as defined in claim 34,
wherein the second portion of each of said bars has a thickness;
wherein the second portion of each of said bars is disposed between two adjacent second portions of said bars; and
wherein the second portion of each of said bars is helically coiled so that the second portion of each of said bars is spaced from each of said two adjacent second portions of said bars by a distance less than the thickness of the second portions of said bars.

39. A switch contact as defined in claim 34 wherein said electrically conductive current-carrying bars constitute the only electrically conductive path between said electrically conductive stem portion and said electrically conductive contact member.

40. A switch contact as defined in claim 34 wherein said electrically conductive bars are composed of a first conductive material and wherein said electrically conductive contact member is composed of a second conductive material different than said first conductive material.

41. An axial magnetic field high voltage vacuum interrupter for interrupting the flow of electrical current in high voltage electrical circuits comprising:
a housing having a substantial vacuum therein; and
first and second switch contacts disposed within said housing and movable with respect to each other between a first position in which said first and second switch contacts are in contact with each other and a second position in which said first and second switch contacts are separated from each other by a distance sufficient to allow a voltage to exist without electrical breakdown following interruption, at least one of said first and second switch contacts comprising:
an electrically conductive stem portion;
a plurality of electrically conductive current-carrying bars each having a first end and a second end, said first ends of said bars being conductively coupled to said electrically conductive stem portion, each of said bars having a first portion which extends radially outward from said stem portion and a second portion which is helically coiled about an axis substantially parallel with said stem portion;
an electrically conductive contact member conductively coupled to said second ends of said electrically conductive bars; and
a support member composed of a solid dielectric material and disposed within the helically coiled second portions of said bars.

42. A switch contact for an axial magnetic field high voltage vacuum interrupter for interrupting the flow of electrical current in high voltage electrical circuits, said switch contact comprising:
an electrically conductive stem portion;
a plurality of individual electrically conductive current-carrying bars each having a first end and a second end, said first ends of said bars being conductively coupled to said electrically conductive stem portion, each of said bars being helically coiled about an axis substantially parallel with said stem portion;
an electrically conductive contact member conductively coupled to said second ends of said electrically conductive bars; and
a support member composed of a solid dielectric material and disposed within the helically coiled second portions of said bars.

43. A switch contact for an axial magnetic field high voltage vacuum interrupter for interrupting the flow of electrical current in high voltage electrical circuits, said switch contact comprising:
an electrically conductive stem portion;
a plurality of individual electrically conductive current-carrying bars each having a first end and a second end, said first ends of said bars being conductively coupled to said electrically conductive stem portion, each of said bars being helically coiled about an axis substantially parallel with said stem portion and having an insulating coating thereon; and
an electrically conductive contact member conductively coupled to said second ends of said electrically conductive bars.

44. A switch contact for an axial magnetic field high voltage vacuum interrupter for interrupting the flow of electrical current in high voltage electrical circuits, said switch contact comprising:
an electrically conductive stem portion;
an electrically conductive contact member; and
electrically conductive means conductively coupled to said stem portion and to said contact member for providing only a single overall, generally cylindrical current path from said stem portion to said contact member, said means comprising a plurality of individual electrically conductive current-carrying bars each of which is helically coiled about an axis substantially parallel to said stem portion.

45. A switch contact assembly which can be twisted to form a helical switch contact, said switch contact assembly comprising:
an electrically conductive stem portion;
a plurality of individual electrically conductive bars conductively coupled to said electrically conductive stem portion, each of said bars having a first end and a second end, said first ends of said bars being conductively coupled to said electrically conductive stem portion, said bars being disposed circumferentially about an axis substantially parallel to said electrically conductive stem portion to define a generally cylindrical space;
an electrically conductive contact member conductively coupled to said second ends of said electrically conductive bars; and
a support member disposed within said generally cylindrical space defined by said bars, said support member being at least partly composed of a dielectric material.

46. A switch contact assembly as defined in claim 45 wherein each of said electrically conductive bars has a portion which is substantially straight and parallel with said axis.

47. A switch contact assembly as defined in claim 45,
wherein said generally cylindrical space defined by said bars has a first length in a direction parallel to said axis;
wherein said support member has a second length in a direction parallel to said axis; and
wherein said first length is substantially greater than said second length.

* * * * *

UNITED STATES PATENT AND TRADEMARK OFFICE

CERTIFICATE OF CORRECTION

PATENT NO. : 5,387,771

DATED : February 7, 1995

INVENTOR : ELMER L. LUEHRING

It is certified that error appears in the above-identified patent and that said Letters Patent is hereby corrected as shown below:

Column 7, line 62, "below initially," should be --below. Initially,--.

Signed and Sealed this

Seventeenth Day of October, 1995

*Attest:*

Bruce Lehman

BRUCE LEHMAN

*Attesting Officer*

*Commissioner of Patents and Trademarks*